United States Patent [19]

Gellert

[11] 3,983,666

[45] Oct. 5, 1976

[54] SHELTER STRUCTURE

[75] Inventor: Donald P. Gellert, Campton, N.H.

[73] Assignee: Foreverly Development Corporation, Boston, Mass.

[22] Filed: Feb. 13, 1975

[21] Appl. No.: 549,800

[52] U.S. Cl. ..... 52/82; 52/80

[51] Int. Cl.[2] ..... E04B 1/32

[58] Field of Search ..... 52/80, 82, 86, 66; 135/1 R

[56] References Cited

UNITED STATES PATENTS

| | | | |
|---|---|---|---|
| 2,802,478 | 8/1957 | Fritsche | 135/1 R |
| 3,468,083 | 9/1969 | Camoletti | 52/82 |
| 3,513,861 | 5/1970 | Johnson | 135/1 R |
| 3,533,202 | 10/1970 | Gellert | 52/80 |
| 3,773,061 | 11/1973 | Berger | 135/1 R |
| 3,802,132 | 4/1974 | Sumner | 52/80 |
| 3,874,396 | 4/1975 | Kirkham | 135/1 R |

FOREIGN PATENTS OR APPLICATIONS

| | | | |
|---|---|---|---|
| 1,109,350 | 6/1961 | Germany | 52/63 |
| 1,027,807 | 4/1966 | United Kingdom | 52/82 |

OTHER PUBLICATIONS

Engineering News Record, June 2, 1949, p. 37.

*Primary Examiner*—Price C. Faw, Jr.
*Assistant Examiner*—Henry Raduazo
*Attorney, Agent, or Firm*—Clarence A. O'Brien; Harvey B. Jacobson

[57] ABSTRACT

A shelter structure constructed of a plurality of modules or lobes each of which includes a pair of triangular panels having curved edges connected together with the apices thereof spread apart and supported by pedestals in elevated relation to a supporting surface. Adjacent edges of the lobes or modules are secured together by a connector and the pedestals are secured to the lower apices of the modules by splice plate assemblies. The lobes or modules are assembled into a building or shelter structure by a unique manipulative procedure to facilitate the construction of a shelter on site thus enabling the modules to be conveyed to the site in a partially assembled condition and then expeditiously set-up and assembled into a shelter structure.

9 Claims, 29 Drawing Figures

C
50°
D
E
C
A
B
A

D
70°32'
B
B = .707A
C > D
40
56
68
60
50
44
E
D
82
76
70
68
A
B
C
A
E
60
68
42
58

Fig. 9
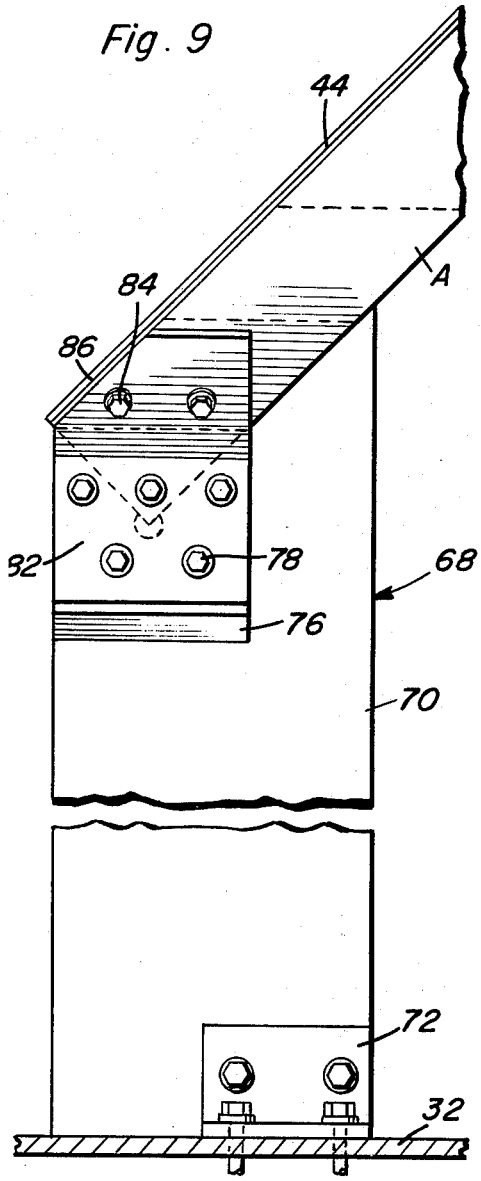
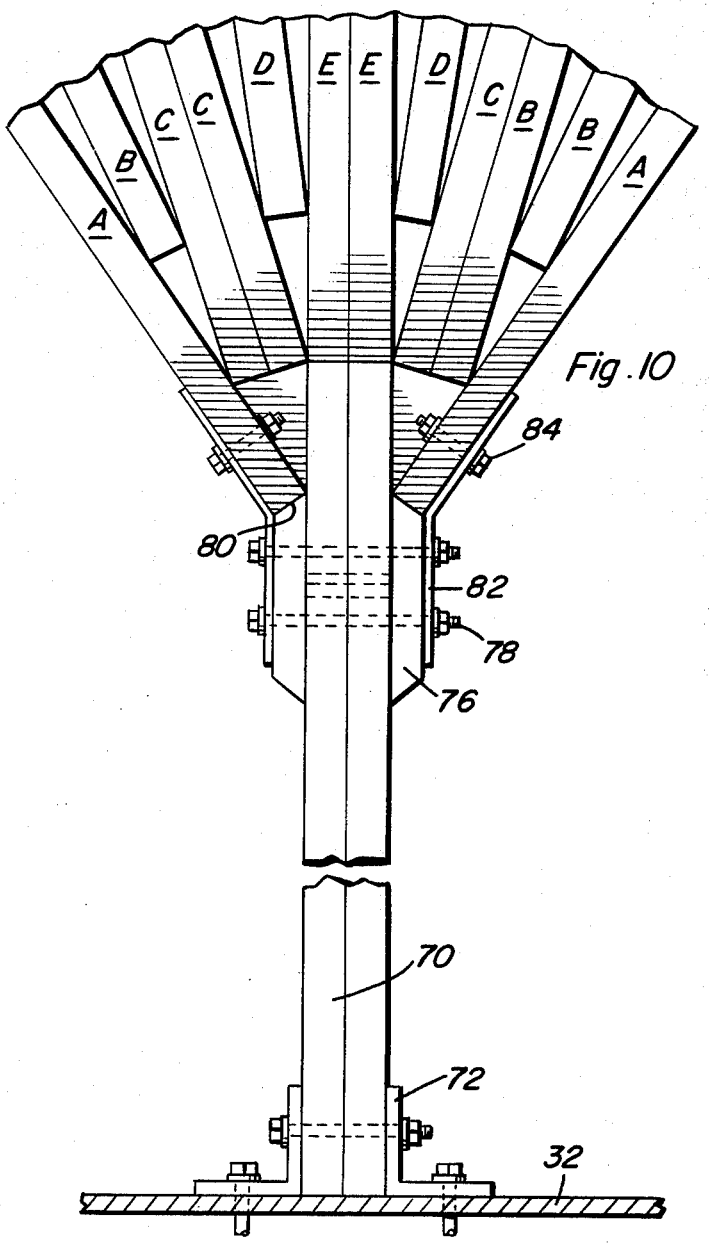
Fig. 10
Fig. 11
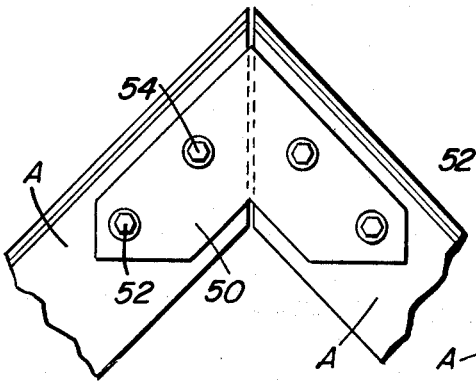
Fig. 12
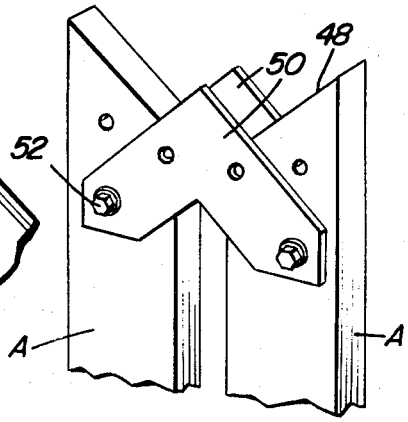
Fig. 13
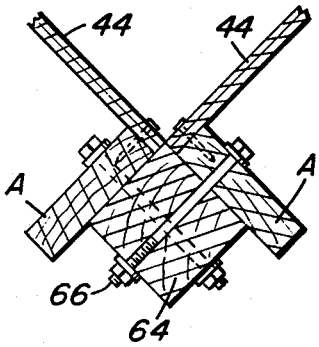

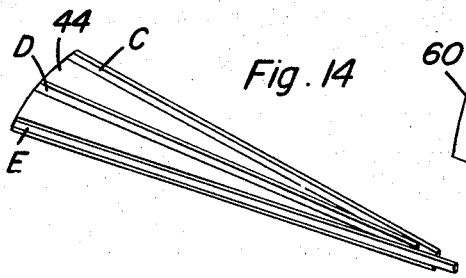
Fig. 14
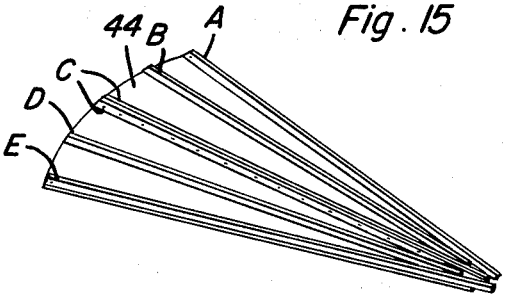
Fig. 15
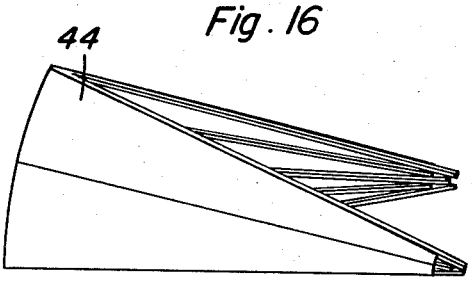
Fig. 16
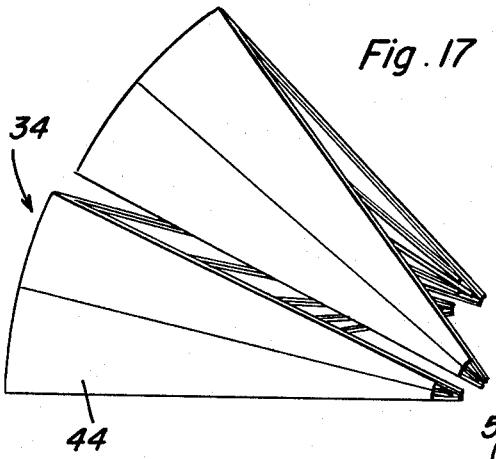
Fig. 17
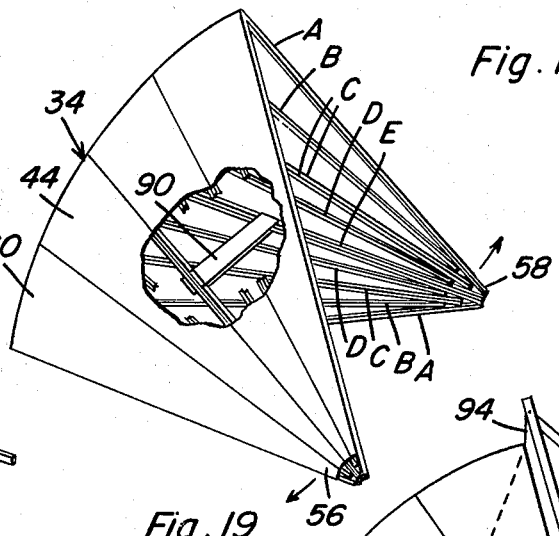
Fig. 18
Fig. 19
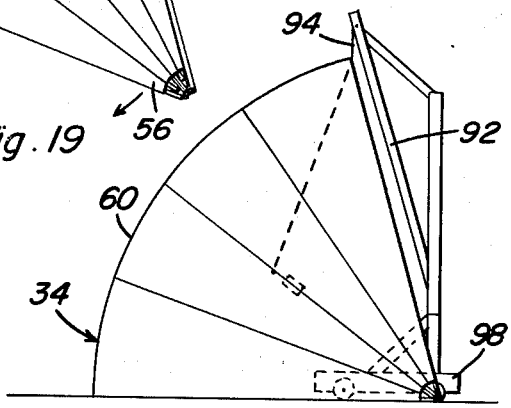
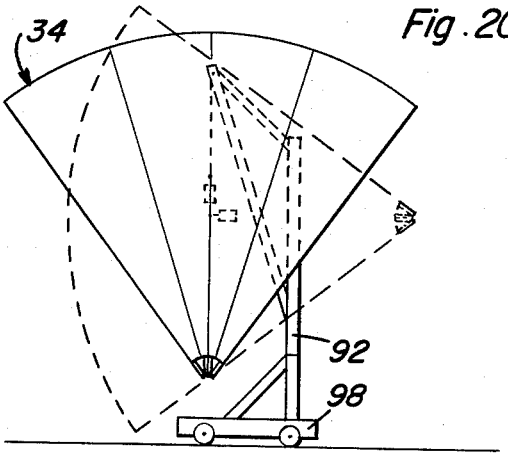
Fig. 20
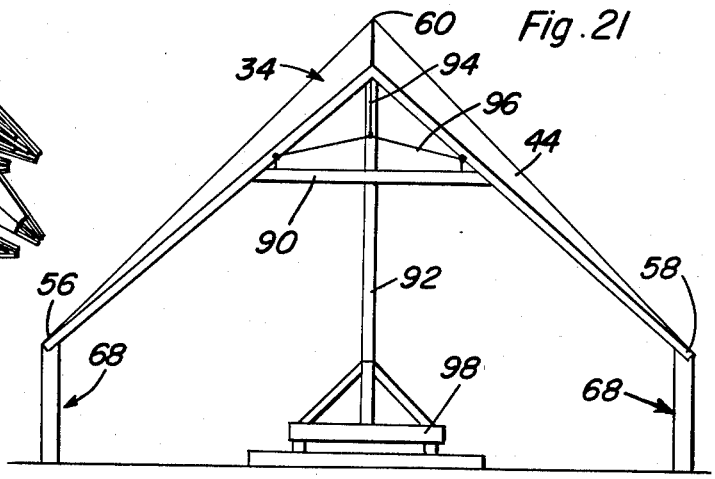
Fig. 21

SHELTER STRUCTURE

BACKGROUND OF THE INVENTION

1. Field of the Invention

The present invention generally relates to a shelter structure and more particularly to a novel and unique module, support pedestal structure associated therewith, connector means between adjacent modules and procedures for setting up and assembling the modules on site to facilitate the construction of a shelter structure.

2. Description of the Prior Art

Shelter structures or buildings constructed from modules consisting of generally triangular panels connected and associated in particular manners are generally well known which enables the panels to be prefabricated in a manufacturing plant and delivered to the construction site in a disassembled or partially assembled condition to facilitate the construction of the shelter. Applicant's prior U.S. Pat. Nos. 3,474,804, 3,533,202, and 3,534,514 disclose prior developments in this field of endeavor with these patents disclosing the basic concept of curved edges of generally triangular panels being secured together with the opposite apices of the panels being spread apart to form a lobe or module. Other patents disclosing developments in this field of endeavor include U.S. Pat. Nos. 3,562,975; 3,636,676; 3,461,626; 3,470,659; 3,534,513; 3,139,958; 3.714,749; 3,332,178; 3,445,970; 3,016,115; 2,716,993; and 3,759,277.

SUMMARY OF THE INVENTION

An object of the present invention is to provide a shelter structure constructed from a plurality of interconnected modules or lobes each of which includes a framework system of rafters which ar hingedly joined and opened in a manner to generate a pair of intersecting conic sections which permits skins which may be either flexible, semi-rigid or rigid to be attached to the rafters either before or after they are pulled apart to transform the single plane of the skins into three-dimensional, cone-shaped sections.

Another object of the invention is to provide a shelter structure in which the conic sections are all identical which permits additional lobes or modules to be added on after original construction as needed.

A further object of the invention is to provide a shelter structure in accordance with the preceding objects in which the conic sections have their apices spread apart and supported in elevated relation to a supporting surface by a pedestal support connected to the rafters in a novel manner which permits the lobe or module to be oriented at a desired elevation above ground level with the pedestal support arrangement enabling the lobe or modules to be joined to each other thereby providing unique stability and resistance to overturning moment both during erection and thereafter.

Still another object of the invention is to provide a shelter structure constructed of a plurality of lobes or modules in accordance with the preceding objects in which a unique procedure of assembly is employed which permits the lobes to be raised from a deck or other supporting surface which is inaccessible to conventional cranes and the like thus enabling on-site assembly of the lobes or modules without requiring elaborate assembly mechanisms although a lifting device is most conveniently employed to elevate the assembled lobes for support from the pedestal supports.

Yet another important feature of the present invention is to provide a shelter structure in accordance with the preceding objects which is relatively inexpensive to manufacture and assemble, adaptable for various assembly arrangements to vary the shelter structure, stable in construction, capable of expansion by adding modules after installation and employing conventional structural components.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 9 is an enlarged side elevational view of one of the pedestal supports and the lower apices of two connected conic sections.

FIG. 10 is an elevational view interiorly of the pedestal and rafter array of FIG. 9.

FIG. 11 is a fragmental elevational view of the connection between the upper ends of the rafters defining the curved edges of the triangular panels.

FIG. 12 is a perspective view of the structure of FIG. 11 illustrating the orientation of the rafters and connector prior to the apices of the triangular panels being spread apart.

FIG. 13 is a sectional view, on an enlarged scale, taken along section line 13—13 illustrating the connecting assembly between adjacent modules or lobes.

FIGS. 14–21 illustrate schematically the sequential steps to be followed in assembling a plurality of modules into a shelter unit.

DESCRIPTION OF THE PREFERRED EMBODIMENTS

Figure 1:
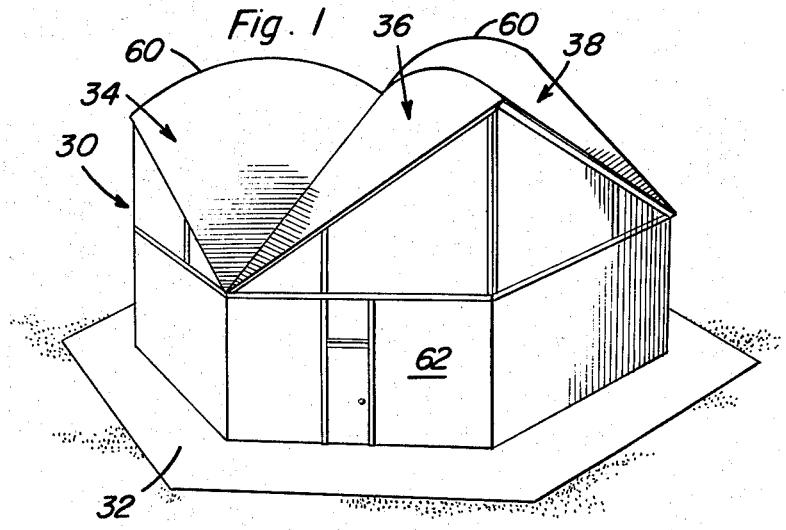
FIG. 1 is a perspective view of a shelter unit constructed in accordance with the present invention.
Figure 2:
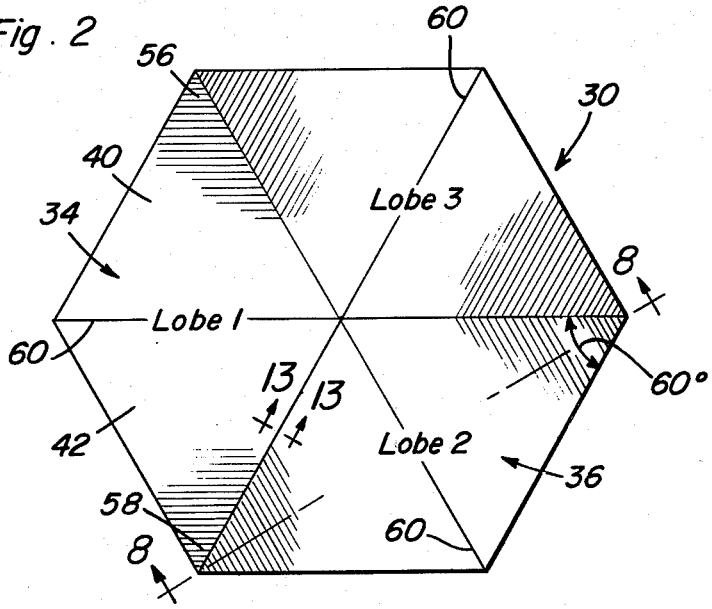
FIG. 2 is a plan view of the structure of FIG. 2.
Figure 6:
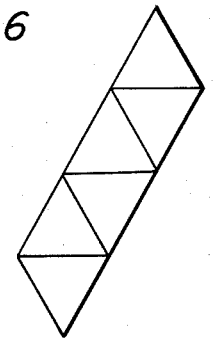
Figure 7:
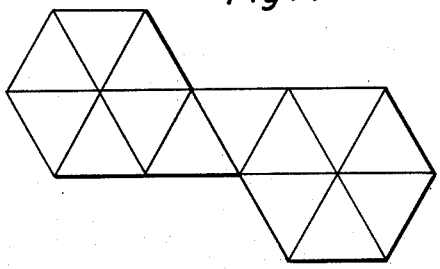

Referring now specifically to the drawings, a shelter structure constructed in accordance with the present invention is illustrated in FIGS. 1 and 2 and is generally designated by reference numeral 30 with the shelter structure being supported on any suitable supporting surface which may be the groung surface or a deck 32 of concrete, wood or the like depending upon the requirements of each individual installation or depending upon the characteristics of each site or the desires of the builder or owner. As illustrated, three lobes or modules are employed in the shelter structure which are designated generally by reference numerals 34, 36 and 38 and labeled in the plan view in FIG. 2.

Each lobe includes a pair of indentical triangular panels 40 and 42 formed by a skin 44 and a rafter array 46 which includes edge rafter A, intermediate rafter B, two central rafters C, an intermediate rafter D, and an edge rafter E, as illustrated in FIG. 10, with all of these rafters having their upper ends 48 cut diagonally at a 45° angle and being interconnected by hinge brackets 50 of angular construction having hinge bolts 52 extending through and connecting pivotally the upper ends of corresponding rafters in the connected edges between the triangular panels 40 and 42. A pair of bolts 54 extend through the legs of the connector brackets and the corresponding rafters in longitudinally spaced relation to the pivot bolts 52 in order to retain the rafters in their spread apart condition. FIG. 12 illustrates a pair of edge rafters A in their generally parallel, unspread condition while FIG. 11 illustrates the same pair of rafters A in their spread apart condition with the bolts 54 in assembled relation. When the triangular panels 40 and 42 are connected and the apices 56 and 58 spread apart to form the module 34, the juncture between the panels 40 and 42 becomes a curved arcuate line 60 defining a ridge line between the panels 40 and 42 with each of the lobes 34, 36 and 38 including an arcuate ridge line so that each of the triangular panels 40 and 42 is changed from a substantially planar member to a conic section when the apices 56 and 58 are spread apart. As illustrated in FIG. 1, vertical wall members 62 may be connected to the free edges of the lobes to form a shelter structure. When it is desired to extend the shelter structure by making it larger, additional lobes may be incorporated therein or lobes may be removed if desired.

Figure 4:
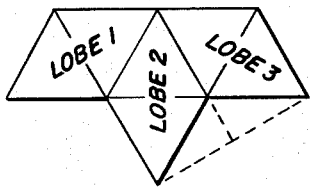
FIGS. 4–7 are schematic views illustrating various arrangements in which the modules or lobes may be assembled.
Figure 5:
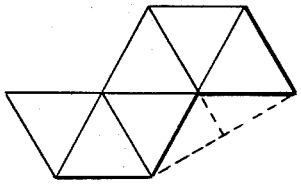
Figure 3:
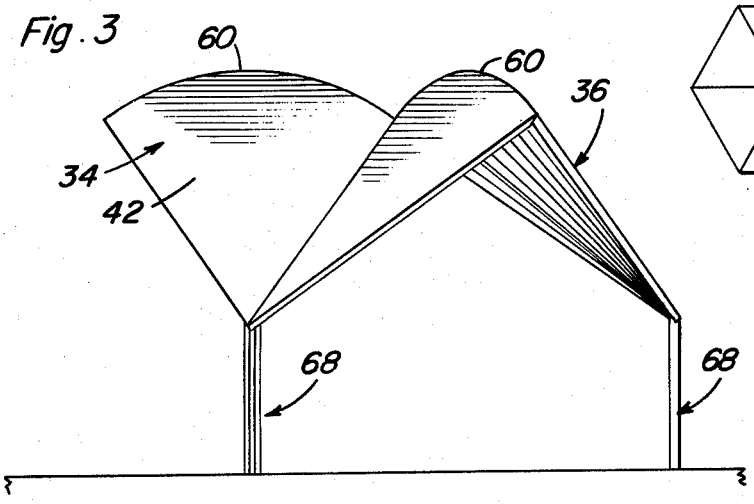
FIG. 3 is a side elevational view of the construction of FIG. 1 with the side walls removed illustrating the pedestal supports and rafter framework.

The structure for connecting adjacent lobes is illustrated in FIG. 13 in which the edge rafters E in FIG. 10 are joined by a connecting member 64 in the form of a square structural element connected to the rafters E by bolts 66 or similar fastening elements. FIGS. 9 and 10 illustrate the structure for supporting the lobes which is in the form of a pedestal generally designated by numeral 68 with the pedestals 68 supporting the apices 56 and 58 of the triangular panels 40 and 42 as well as the corresponding apices on adjacent lobes as illustrated in FIG. 3. Thus, depending upon the arrangement of the lobes, the pedestals 68 will support a single apex of a lobe or the connected apices of two lobes. FIGS. 4–7 illustrate various lobe arrangements with each lobe including two triangular panels. FIGS. 4 and 5 illustrate the capability of employing half lobes when desired which are illustrated by the broken lines in FIGS. 4 and 5. In certain instances, introduction of half lobe sections produces certain efficiencies. For example, the external wall area may actually be reduced while affording a larger floor area when using a half lobe section.

The pedestal assembly 68 includes a pair of structural members 70 secured to the supporting platform or base 32 by angle iron brackets 72 or the like with the upper end of the member 70 being provided with a notch 74 therein receiving the lower ends of the rafters E with the notch 74 having a generally right-angular configuration as illustrated in FIG. 9. For supporting the outer edge rafters A in the lobe, a pair of corbel plates 76 are attached to the pedestal member 70 by fastening bolts 78 with the upper edges of the corbel plates 76 being beveled as at 80 to abuttingly engage the lower ends of the edge rafters A. An angulated splice plate 82 is fastened to the outer surfaces of the corbel plates 76 by the bolts 78 and the upper end portion of each of the splice plates 82 is angulated outwardly and is disposed along the outer surface of the outer edge rafters A and are secured thereto by bolts 84. The upper outer corner of the splice plate 82 is beveled as at 86 to conform with the inclination of the upper edge of the rafters A and the roof skin thereon.

Figures 8, 22, 23:
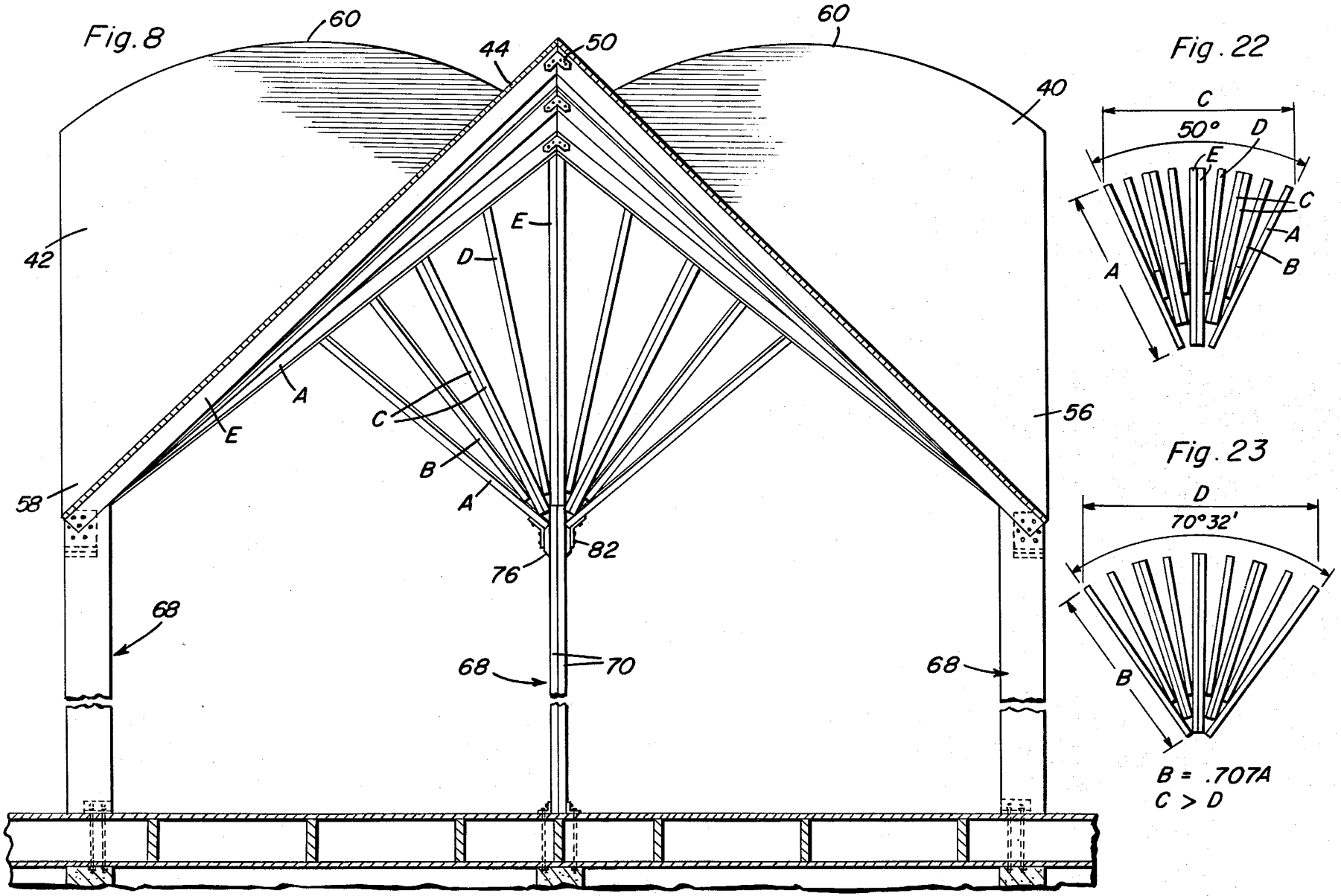
FIG. 8 is a vertical sectional view, on an enlarged scale, taken substantially upon a plane passing along section line 8—8 of FIG. 2 illustrating the rafter array, connectors therebetween and pedestal supports therefor.
FIG. 22 illustrates the angular extent of the circular sector of each lobe face prior to the triangular panels being spread apart.
FIG. 23 is a view similar to FIG. 22 but illustrating the circular sector of each lobe face after the triangular panels have been spread apart.

In the assembly, rafter B is trapped between rafters A and C and rafter D is trapped between rafters E and C and the two rafters C are trapped between rafters A and E. The rafters, except for E have a 45° diagonal or bevel cut at their lower ends so that they will be properly trapped and supported due to their relationship to each other and due to the conical section being formed when the apices of adjacent panels are spread apart. The skin 44 may be a plurality of triangular panels of laminated wood such as plywood or the like or any other suitable material with roofing material of any various type applied to the shelter structure. FIG. 22 illustrates a plan view of an array of rafters prior to spreading illustrating an arcuate segment of approximately 50° having dimensional characteristics A and C while FIG. 23 illustrates the array of rafters after spreading having an arcuate extent of approximately 70° and dimemsional characteristics B and D in which dimensional characteristic C in FIG. 22 is greater than dimensional characteristic B in FIG. 23 and the dimemsional characteristic B in FIG. 23 is .707 A with FIG. 22 depicting the undeveloped cone or planar arrangement and FIG. 23 depicting the developed cone or conic section which curves when the apices are apread apart.

When the apices are spread apart, the included angle between the rafters E is 90° and the distance between the apices is 1.414 A.

FIGS. 14–21 illustrate a procedure of assembly in which FIG. 14 discloses a central section of one of the triangular panels including rafters E, D and C with a skin 44 attached thereto and FIG. 15 illustrates the assembly of an outside section to the central section with rafters C, B and A added thereto. FIG. 16 illustrates half of the triangular panels joined at their curved edge while FIG. 17 illustrates the manner in which the second half of each of the triangular panels are secured together thus forming a lobe as illustrated in FIG. 18. The apices of the lobe are spread apart as illustrated by the arrows in FIG. 18 and retained in this position by a bracing member 90. A lifting crane 92 ia then employed to elevate the lobe 34 and to orient it with the two apices 56 and 58 downwardly which is accomplished by the flexible lift line or cable 94 being attached to a bridle 96 connected at its ends to the brace member 90. The crane structure 92 may be mounted on any suitable base 98 and is only schematically illustrated. In this arrangement, when the top edge of the lobe 34 is elevated to a position above the crane boom or the like, the fact that the point of attachment of the lift cable 94 is above the center of gravity of the lobe 34, the lobe 34 will be automatically oriented in the full line position illustrated in FIG. 20 with the apices 56 and 58 disposed downwardly so that the pedestal support 68 may then be installed.

Figure 28:
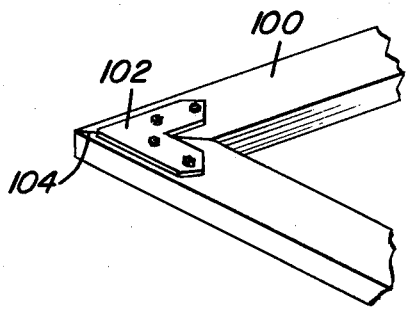
FIG. 28 illustrates the mitered construction of the upper end of the rafters and the connector therebetween.
Figure 29:
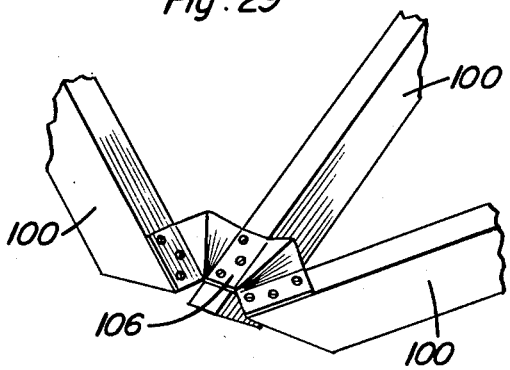
FIG. 29 illustrates an accordion hinge structure connecting the lower ends of the rafters in the embodiment of the invention illustrated in FIGS. 24–27.

FIGS. 24–29 illustrate a series of rafters 100 which are hinged together by the gusset hinge 102 which enables the rafters 100 to be oriented in parallel relation to each other as illustrated in FIG. 4 with the gusset hinges being illustrated in FIG. 28 in which the rafters are locked in angular relation. The ends of the rafters 100 are mitered as at 104 so that when they are in their angular orientation, the mitered edges engage each other. The lower ends of the rafters 100 are connected together by an accordion hinge assembly 106 which enables the mirror image rafters 100 to be pivoted apart to form a lobe with the apices of the lobes at the lower ends thereof also being spreadable.

Figure 24:
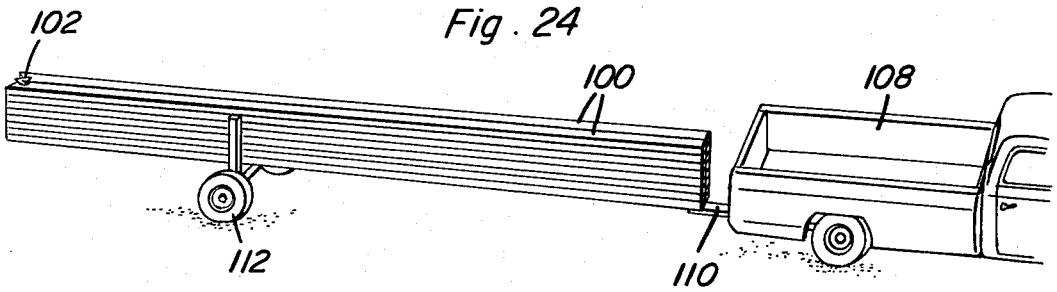
FIGS. 24–27 illustrate the procedural sequence followed in setting up a modified embodiment of the shelter structure in which the upper ends of the rafters are connected hingedly and a flexible skin is connected to the rafters.
Figure 25:
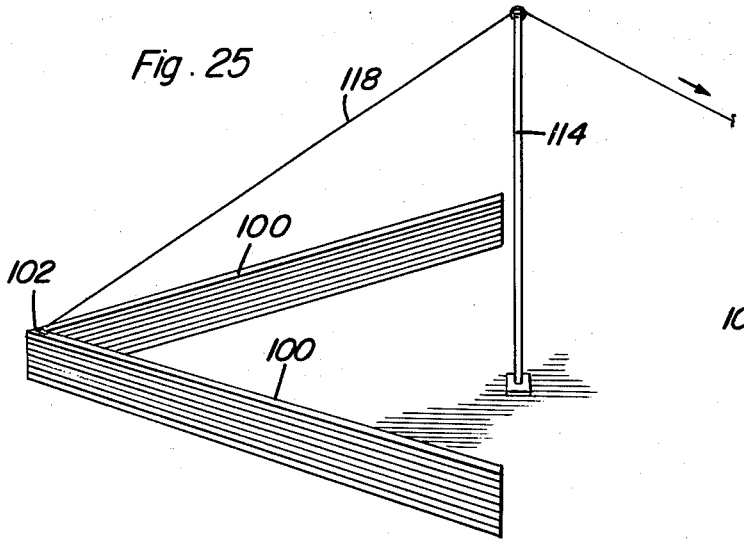
Figure 26:
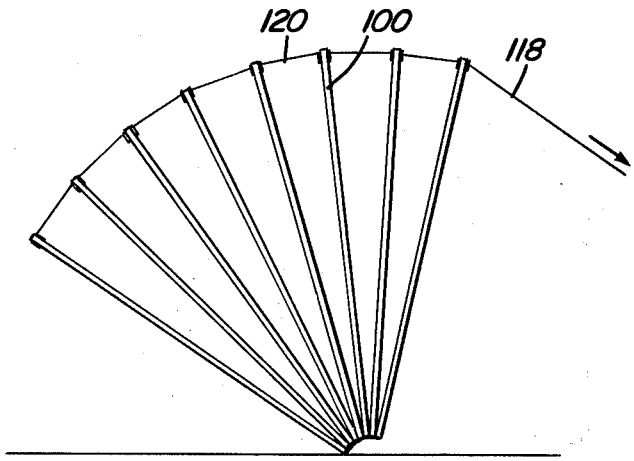
Figure 27:
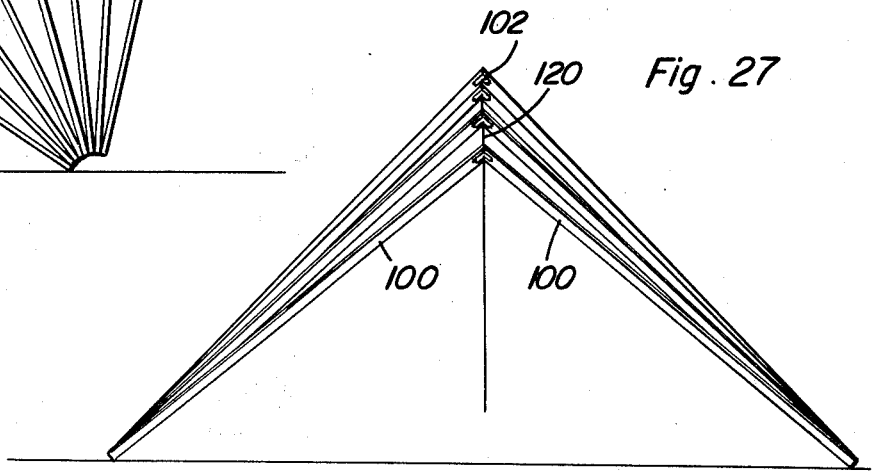

With the rafters in their collapsed position as illustrated in FIG. 24, the assembly may be towed to a site by the use of a suitable towing vehicle 108 and a trailering connection 110 to a supporting trailer or attachable wheels 112. The trailer and hitch may be self-contained or the wheel assembly may be attached directly to the rafters and the hitch 110 attached to the forward end of the collapsed rafter assembly. Upon reaching a site, the rafters 100 are spread apart in the manner illustrated in FIG. 25 and rigidly secured in this position by inserting the upper bolts through the gusset plates 102. An upstanding mast, pole or other vertical support 114 having a pulley 116 at the upper end thereof and an elongated cable 118 may be employed for fanning the rafters 100 into an upright position to form a lobe as illustrated in FIG. 26. The cable 118 may be pulled manually or with any suitable manual or powered winch mechanism so that the array of rafters forms itself into a framework of a pair of intersecting conic sections. The rafters 100 are interconnected by a flexible tension member or members 120 at their upper extremities so that as each set of rafters is pulled away from its position parallel to the ground, that tension member becomes fully extended and finally exerts force on the next set of rafters in its turn so that a shelter framework is formed. The framework may be covered with a flexible covering, a semi-rigid covering or a series of rigid sections. The flexible covering may be applied before or after fanning and stressing or anchoring, the semi-rigid covering may be applied after fanning but before or after stressing and the rigid covering may be applied after stressing between adjacent rafters.

The circular sector or each lobe face is approximately 50° as illustrated in FIG. 22 before it is hinged and deformed by stretching into a conic section. When hinged and stretched, the angle included becomes 90° or someother angle approximately 90° included between the panels at the connected curved edges depending upon choice and requirement. When stretched to have an included angle of 90°, the angle reduces to approximately 49° and the distance between the apices of the two lobe faces is 1.414 times the radius of the lobe. However, in elevation, the angle of the lobe face is deformed and foreshortened to 70° 32 minutes which is the dihedral angle of a right tetrahedron so that in plan view the two lobe faces form a pair of equilateral triangles having a 60° apex angle as seen in FIG. 2. FIG. 13 illustrates adjacent lobes being joined together by means of the long square cross section member bolted to the outside rafter members underneath the joining valley.

The gusset plates 50 also serve as hinge plates and all of the rafters except the rafters E are cut at 45° at their lower ends so that when the rafters move from a circular array into a conical array, the face formed by the 45° cut is parallel to the central axis of the intersecting cones. It is pointed out that other hinging systems may be employed to preserve the symmetry of the rafters in lieu of the gusset hinge plates 50 with it being essential that the rafters be hingedly connected but secured in a stable angular orientation. The lower ends of the rafters are so arranged that when they are orientated in their conic array, the 45° edge cut comes in to contact along its full length with adjacent rafters with the rafters A being bolted to the splice plate 82.

While multiple lobes have been primarily disclosed, it is pointed out that a single lobe and a half lobe are useful structures by themselves or in any combination with other lobes. Also, while a conic section or configuration of each panel has been illustrated and described, the princple is equally applicable to parabolic, elliptical, free-form and compound curve sections.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A shelter unit comprising a plurality of connected lobes, each of said lobes comprising a pair of triangular panels each having a plurality of rafters radiating from an apex, the apices of said panels being spread apart with the panels each defining a conic section, the conic sections intersecting and being joined together to provide a curved ridge line between the panels, and a pedestal support engaging each of the apices of the lobe for supporting the lobe in elevated relation to a supporting surface, each pedestal support including an upwardly facing notch in the upper edge thereof conforming with and receiving the end portion of a central rafter in the panel splice plates connecting the pedestal support and the outermost rafters in the panel, and intermediate rafters secured between the supported rafters.

2. The structure as defined in claim 1 wherein said splice plates are of angular configuration and are attached to the pedestal support by corbel plates.

3. The structure as defined is claim 1 wherein the panels, prior to spreading the apices apart define a face angle of approximately 50 ° and when spread the angle drops to approximately 49° while in elevation view the angle becomes approximately 70° 32′ which is the dihedral angle of a right tetrahedron with an included angle between the panels of approximately 90° and the elevational radius of the panel when the apices are spread apart being 0.707 of the radius of the panel prior to spreading the apices apart.

4. The structure as defined in claim 1 wherein said rafters include mitered ends remote from the apex of the triangular panel, and gusset plates interconnecting the mitered ends of corresponding rafters on the connected panels with the gusset plates forming hinge connections having spaced axes to enable the rafters in the connected panels to be disposed in adjacent parallel relation and then spread apart with fasteners inserted through the plates and rafters in spaced relation to the hinge axes for rigidly securing the rafters in downwardly diverging relation when the apices of the panels are spread apart.

5. The structure as defined in claim 1 wherein said lobes have straight edge portions extending from the spaced apices to the ends of the curved ridge line, said straight edges of adjacent lobes being connected together to define a roof structure having a plurality of curved ridge lines and a plurality of straight edge portions and valleys with the pedestal supports supporting apices of connected lobes when the apices are adjacent each other.

6. A shelter unit in the form of a lobe comprising a pair of generally triangular panels, each panel having a plurality of rigid rafters radiating from an apex and a curved edge remote from the apex, the apices of said panels being spaced apart with the panels each defining a conic section, the curved edges of the conic sections being rigidly joined together to form a rigid, arcuately curved ridge line between the panels, and a support engaging each of the apices of the lobe for supporting the lobe from a supporting surface.

7. A shelter unit in the form of a lobe comprising a pair of generally triangular panels, each panel having a plurality of rafters radiating from an apex and a curved edge remote from the apex, the apices of said panels being spaced apart with the panels each defining a conic section, the curved edges of the conic sections being joined together to form a curved ridge line between the panels, and a pedestal support engaging each of the apices of the lobe for supporting the lobe in elevated relation to a supporting surface, each pedestal support including an upwardly facing notch in the upper edge thereof conforming with and receiving the end portion of a central rafter in the panel and means on each pedestal support for supporting engagement with the outermost rafters in the panel with the intermediate rafters in the panel being secured between the central rafter and the outermost rafters.

8. The structure as defined in claim 7 wherein said means supporting the outermost rafters from the pedestal support includes corbel plates on each side of the pedestal support, and splice plates connecting the corbel plates and the outermost rafters, said splice plates being of angular configuration with the upper edges of the corbel plates being inclined to conform with the end edges of the outermost rafters.

9. The structure as defined in claim 7 wherein the outer ends of the rafters are mitered, gusset plates interconnecting the mitered ends of corresponding rafters on the connected panels with the gusset plates defining a hinge connection having spaced axes to enable pivotal movement of the rafters from a position along side of each other to a position with the mitered ends in abutting relationship, and fastener means connecting the gusset plates to the rafters in spaced relation to the hinge axes when the rafters are spread apart with the mitered ends in abutting relation thereby rigidly securing the rafters in downwardly diverging relation when the apices of the panels are spaced apart.

* * * * *